United States Patent [19]

Carter et al.

[11] 4,088,612

[45] May 9, 1978

[54] DETERGENT COMPOSITIONS

[75] Inventors: Malcolm Nigel Alan Carter, West Kirby; Brian McGhee, Thingwall; John Fielden Helliwell, Heswall; John Kerr Marshall, Little Neston; Appayya Raghunath Naik, Port Sunlight, all of England

[73] Assignee: Lever Brothers Company, New York, N.Y.

[21] Appl. No.: 757,820

[22] Filed: Jan. 4, 1977

Related U.S. Application Data

[63] Continuation of Ser. No. 423,495, Dec. 12, 1973, abandoned, which is a continuation of Ser. No. 228,419, Feb. 22, 1972, abandoned, which is a continuation of Ser. No. 849,156, Aug. 11, 1969, abandoned.

[30] Foreign Application Priority Data

Aug. 15, 1968 United Kingdom ..... 39103/68
Aug. 15, 1968 United Kingdom ..... 39104/68

[51] Int. Cl.[2] ..... C11D 1/92; C11D 1/94

[52] U.S. Cl. ..... 252/545; 252/526; 252/544; 252/550; 252/553; 252/DIG. 7; 252/DIG. 14; 260/294.8 S; 260/501.12

[58] Field of Search ..... 252/545, 153, 526, 544, 252/110, 117, DIG. 14, DIG. 7, 550, 553; 260/501.12, 294.8 S

[56] References Cited

U.S. PATENT DOCUMENTS

| | | | |
|---|---|---|---|
| 3,280,179 | 10/1966 | Ernst | 252/117 X |
| 3,332,875 | 7/1967 | Kessler et al. | 252/526 |
| 3,424,693 | 1/1969 | Stein et al. | 260/501.12 |
| 3,533,955 | 10/1970 | Pader et al. | 252/153 |
| 3,630,929 | 12/1971 | Van Dijke | 252/136 |

FOREIGN PATENT DOCUMENTS

| | | | |
|---|---|---|---|
| 1,064,169 | 4/1967 | United Kingdom | 260/294.8 S |

OTHER PUBLICATIONS

"The Chemistry of Fatty Acids", published by the Armour Industrial Chemical Co., 1959.
"Chemifats", by the Archer-Daniels-Midland Company, 1958.

*Primary Examiner*—Thomas J. Herbert, Jr.
*Attorney, Agent, or Firm*—Michael J. Kelly; James J. Farrell; Melvin H. Kurtz

[57] ABSTRACT

A detergent composition comprising a sulphobetaine, which can be prepared by reaction between a sultone and a tertiary amine, and an anionic detergent active compound in a molar ratio of at least 1 part to 2 parts, respectively. The compositions are effective in the absence of a detergency builder.

15 Claims, No Drawings

DETERGENT COMPOSITIONS

This application is a continuation of Ser. No. 423,495 filed Dec. 12, 1973, now abandoned; which in turn was a continuation of Ser. No. 228,419 filed Feb. 22, 1972, now abandoned, which in turn was a continuation of Ser. No. 849,156 filed Aug. 11, 1969 now abandoned.

The invention relates to compositions which have, in different aspects, wide utilities for fabric washing and in other fields of detergency.

Conventional fabric washing compositions commonly incorporate anionic detergent active compounds such as alkyl benzene sulphonates. To have effective detergencies such compositions require the presence of detergency builders, for example condensed phosphates such as sodium tripolyphosphate. It has, however, been suggested that the use of condensed phosphate builders contributes to eutrophication problems, whilst other detergency builders, including for example sodium ethylene diamine tetracetate (EDTA) and sodium nitrilotriacetate (NTA), are generally more expensive. It would therefore be advantageous to produce detergent compositions which have effective detergencies without requiring the presence of detergency builders.

Conventional fabric washing compositions also suffer from the disadvantage that they are not very effective when used in cool water. Certain fabrics, including particularly the so-called "drip-dry" fabrics, are desirably washed in cool water so as to minimize the deterioration of their "drip-dry" properties. Moreover, in many so-called developing countries hot water is not generally available for fabric washing purposes. It would therefore be advantageous to produce detergent compositions having effective detergencies in cool water, whilst preferably also being effective in hot water fabric washing.

In fields of detergency other than fabric washing, it is commonly desirable to provide detergent compositions with particularly good lathering properties, either as regards the volumes of the lathers produced or the stabilities of the lathers. Dishwashing compositions, in particular, should generally produce abundant lathers which are stable even in the presence of relative large amounts of fatty soils.

It has now been found that particular sulphobetaines which can be made relatively simply and cheaply have outstanding detergent properties in both soft and hard waters at high and low temperatures, even in the absence of conventional detergency builders, and can be used in detergent compositions of wide potential utility.

According to the present invention a detergent composition comprises (A) at least one water soluble sulphobetaine having the structural formula

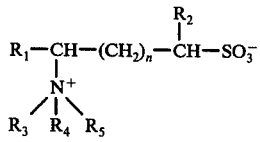

(I)

wherein $R_1$ is an alkyl group, $R_2$ is a hydrogen atom or an alkyl group, the total number of carbon atoms in $R_1$ and $R_2$ being from 8 to 16,

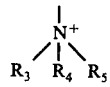

represents a quaternary amino group in which each group $R_3$, $R_4$ and $R_5$ is an alkyl or hydroxy alkyl group or the groups $R_3$, $R_4$ and $R_5$ are conjoined in a heterocyclic ring, and $n$ is 1 or 2, and (B) at least one anionic detergent active compound, the molar ratio of the amount of the sulphobetaine to that of the anionic compound being not less than 1 part to 2 parts, respectively.

In such compositions having the better detergencies, as for example in the case of compositions adapted for fabric washing, it is desirable that the amount of anionic detergent active compounds present should be not more than about 10 percent by weight on the amount of the sulphobetaine. Preferably up to only about 5 percent by weight of the anionic compounds on the amount of the sulphobetaine is present in such compositions.

Compositions having the better lathering properties should generally comprise the sulphobetaines and anionic detergent active compounds in molar ratios of from about 3:1 to 1:2. Preferably the ratio between the sulphobetaines and the anionic compounds should be from about 3:2 to 2:3. However, with some combinations of sulphobetaines and anionic compounds, very good lathering properties are still achieved outside these molar ratios and compositions being satisfactory combinations of lathering and detergency properties can be so attained.

The sulphobetaines which are used in the compositions of the present invention are obtainable by reaction between tertiary amines and sultones. Tertiary amines are, of course, readily available and methods for the production of sultones are well-known. Commercially, sultones are usually produced by the sulphonation of olefins, particularly $\alpha$-olefins. When the process is conducted under optimum conditions, the resultant mixture contains a high proportion of water-insoluble sultones with a number of other reaction products, mainly alkene sulphonic acids. If the sulphonic acids are neutralized by the addition to the mixture of an aqueous alkaline solution, the resultant salts dissolve in the solution used to leave the sultones in a supernatent layer which can be separated readily from the solution.

A variety of different sultones are generally produced by the sulphonation of olefins, depending on the purity of the feed stock and the conditions of the reaction. However, the majority of the sultones produced have the general formula:

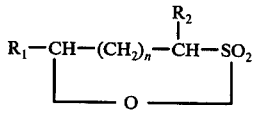

(II)

wherein $R_1$, $R_2$ and $n$ have the same significance as in formula (I), when the olefins have the appropriate carbon chain lengths. Where $n$ is 1 the compound is a $\gamma$-sultone and where $n$ is 2 the compound is a $\delta$-sultone. Other sultones may be produced in minor amounts but they are thought to be relatively unstable. It is not necessary to separate the $\gamma$- and the $\delta$-sultones for the preparation of the sulphobetaines although this can be accomplished if desired, for example by column-chromatography. Such separation would generally be commercially uneconomical.

The number of carbon atoms in the olefins used to form the sultones may be varied between the limits of from about 11 to 20 carbon atoms, so giving from 8 to 16 carbon atoms, preferably at least 10 carbon atoms, in the groups $R_1$ and $R_2$ in the sulphobetaines of formula (I). The olefins used commercially are usually in the form of mixtures of olefins, particularly as regards their carbon chain lengths and sometimes also in the positions of the ethylenic bonds, as in the case of the so-called random olefins. Preferably, however, the olefins are predominently linear $\alpha$-olefins, in which case the group $R_1$ is predominantly a linear alkyl group and the group $R_2$ is predominantly hydrogen, referring again to formula (I).

The sulphobetaines of formula (I) are produced by reacting the sultones with tertiary amines. Any tertiary amine capable of reacting with a suitable sultone to give a sulphobetaine having the formula (I) may be used. The preferred tertiary amine is pyridine as this compound reacts readily and in good yield with the sultones and it has been found that the resultant alkyl-$\gamma$- and $\delta$-pyridine sulphobetaines are very effective in the compositions of the invention. Alternative tertiary amines are alkylpyridines, preferably picolines, and lower ($C_{1-4}$) tri-alkyl and hydroxy alkyl amines, for example trimethylamino, triethylamine and triethanolamine, Some higher trialkyl amines do not react readily with the sultones to give sulphobetaines due, it is believed, to steric hindrance, and the use of multiple ring heterocyclic tertiary amines such as iso-quinoline tends to result in sulphobetaines which are not water-soluble.

The reaction between tertiary amines and sultones may be conducted in the presence of organic solvents, if desired and the temperature of reaction may be varied from ambient temperature up to the temperature at which the amine or any solvent used boils under the pressure applied. During the reaction between the amines and the sultones some quaternary ammonium salts of the sulphonic acids may also be formed, the tendency for this to happen being greater if harsh conditions are used for the reaction and the amines are ones which due to steric hindrance less readily form the desired sulphobetaines.

The anionic detergent active compounds desirably used in conjunction with the sulphobetaines in compositions having improved lathering properties are preferably detergent active sulphonaten and sulphaten, examples of which are as follows:

(a) alkyl sulphonates (usually $C_8$–$C_{16}$, preferably $C_{10}$–$C_{12}$),
(b) alkyl benzene sulphonates (usually alkyl $C_4$–$C_{14}$, preferably $C_8$–$C_{12}$),
(c) olefin sulphonates (usually $C_{10}$–$C_{16}$, preferably $C_{12}$–$C_{14}$),
(d) alkyl sulphates (usually $C_{10}$–$C_{16}$, preferably $C_{12}$),
(e) alkyl ether sulphates (usually 1–6 ethylene oxide (EO) units, alkyl $C_{10}$–$C_{16}$, preferably alkyl $C_{12}$–$C_{14}$), and less preferably
(f) N-methyl taurates (usually $C_8$–$C_{14}$, preferably $C_{12}$), and
(g) acyl isothionates (usually $C_{10-16}$, preferably $C_{12}$).

The term "olefin sulphonate" is used above to describe the material obtained by the hydrolysis and neutralization of the reaction product of sulphonation of an olefin. The material is a mixture of predominantly hydroxyalkyl sulphonates and disulphonates, alkene sulphonates and alkene disulphonates.

These and other anionic detergent active compounds are well-known in the art and are well exemplified in the literature, for example in "Surface Active Agents and Detergents" Volume I (1949) and Volume II (1958) by Schwartz, Perry and Borch. The total amounts of the sulphobetaine and the anionic detergent active compound in a composition of the invention may be varied widely, but is preferably from about 10 to about 50 percent by weight. The amount varies according to the use for which the compositions are intended, for example in the case of shampoos a content of sulphobetaine and anionic compound within the range of from about 10 to 20 percent will generally be satisfactory whilst for liquid dishwashing compositions an amount of from about 20 to about 40 percent is generally preferred. The amount of sulphobetaine alone is generally in the range of from about 10 to about 35 percent by weight, higher proportions being preferable in the case of compositions particularly adapted for fabric washing.

The possible utility of the compositions of the invention in fields of differing requirements as regards the detergent and lathering properties of the compositions is economically beneficial in permitting a range of compositions to be prepared from a single sulphobetaine and commercially available or readily produceable anionic detergent active compounds, simply by varying the ratio between the ingredients, with of course the addition of conventional appropriate to the compositions. The variation in detergency and lathering is believed to be caused by some form of interaction between the molecules of the sulphobetaines and of the anionic compounds when in use in aqueous solution. The degree of apparent interaction varies according in particular to the molecular configurations and carbon chain lengths of the respective compounds and also on the degree of hardness of the water used. Generally the effect on detergency is more noticeable in hard water.

It is a particular advantage of the detergent compositions of the present invention that they do not necessarily require the presence of detergency builders in order for them to have satisfactory properties, even in the case of the compositions of improved detergency which are adapted for fabric washing. The compositions can then contain higher proportions of detergent active compounds than otherwise, so allowing decreased packaging and transport costs and requiring smaller amounts of the compositions to be used by the housewife in preparing satisfactory washing solutions. The possible use of unbuilt detergent compositions is also advantageous in areas where the use of condensed phosphate builders is thought to give rise to effluent problems. Other organic detergency builders are generally more expensive than phosphate builders so making their use commercially less attractive.

It should, however, be appreciated that if it is desired, conventional detergency builders may be included in the compositions of the invention, particularly those intended for fabric washing, and in general even further improvements in detergency are obtainable by so doing. The presence of detergency builders in the fabric washing compositions is noticeably beneficial when the compositions are used to wash fabrics soiled with particulate soils rather than fatty soils. Many types of detergency builders are known in the art and are well exemplified in the literature, for example in the books "Surface Active Agents and Detergents" mentioned earlier. Specific detergency builders which may be mentioned are sodium tripolyphosphate, sodium nitrilotriacetate, sodium ethylene diaminotetracetate and polyelectrolyis builders such as sodium polyacrylate and the sodium salt of copolyethylene-valnic acid.

The compositions according to the invention may be solid compositions, that is in powdered, granular or tablet form, semi-solid, that is paste or gel, compositions, or they may be liquid compositions. Whereas powdered or granular compositions have hitherto generally been more acceptable to housewives, such compositions possess inherent disadvantages in their tendency to form dust and their low bulk densities leading to increased storage and transport costs. The compositions of the present invention are particularly effective in liquid form when the possible absence of a detergency builder facilitates the production of homogeneous stable products. Liquid compositions are particularly convenient for domestic dishwashing purposes where only small doses of composition are required and rapid dissolution of the composition is desirable.

In addition to the curential sulphobetaines, the compositions of the invention may comprise conventional additives including, for example, perfumes, colourants, fungicides, germicides, enzymes, fluorescent agents, anti-redeposition agents such as sodium carboxymethyl cellulose, hydrotropes such as alkali metal aryl sulphonates and also in the case of liquid compositions opacifiers and organic solvents such as lower aliphatic alcohols. Bleaches such as sodium perborate with or without the presence of peracetic acid precursors such as tetraacetyl ethylene diamine, and inorganic salts such as sodium carbonate, sodium sulphate, sodium chloride and sodium silicate, may also be present if desired.

It will be appreciated that some of the additives mentioned above, particularly the anti-redeposition agents, bleaches and also detergency builders, are more commonly used in detergent compositions adapted for fabric washing than in compositions which are primarily intended for applications in which good lathering properties are more important than high detergencies as, for example, in the case of dishwashing compositions.

Nonionic detergent active compounds may also be incorporated in the compositions of the invention if desired. Nonionic compounds generally act as lather or suds depressents which can be desirable in the case of compositions adapted for fabric washing in lather-intolerant washing machines. Specific nonionic detergent active compounds which may be mentioned are alkyl and alkylphenol alkylene oxide condensation products. These and other nonionic compounds are well-known in the art and exemplified in the literature, for example in the books "Surface Active Agents and Detergents" mentioned earlier. Cationic detergent active compounds generally have adverse effects on the detergencies of the compositions and they are preferably absent from fabric washing compositions, if present they should only be used in minor amounts.

The invention is further described by the following Examples, in which parts and percentages are by weight except where otherwise indicated and water hardness figures quoted are expressed by the French hardness scale.

In the Examples the properties of the compositions were evaluated using the following tests:

DETERGENCY TEST

This is accomplished by washing soiled pieces of fabric (cambric cotton except where otherwise specified) in detergent solutions using a repeatable amount of agitation and the same fabric/solution ratio in each case. The cotton pieces are impregnated with 1.5 percent by weight of a synthetic, carbon-14 labelled, sodium applied in benzene solution, the benzene being subsequently removed by evaporation. The radioactivity of the fabric pieces before and after washing is measured and the percentage detergency found from the equation:

$$\text{Detergency (\%)} = C_1 - C_2/C_1 \times 100$$

where $C_1$ is the radioactive count before washing and $C_2$ is the radioactive count after washing.

For each test the procedure is completed in quadruplicate and the repeatability of the test is on average i about 2%.

LATHER STABILITY TEST

This test measures the stability of a lather during the continuing addition of a soil to a lathering solution and simulates a domestic dishwashing procedure.

One liter of an aqueous solution of the detergent active agents under test is whisked for 1 minute to generate a lather. The solution is then stirred with a paddle and amounts of a synthetic soil (a mixture of triglycerides, fatty acids, flour and egg) are added to the solution, the stirring is stopped at set intervals to allow the measurement of the height of the lather and the test is continued until the lather drops to a predetermined low level. The amount of soil added is then recorded.

PLATE WASHING TEST

This test again simulates a domestic dishwashing procedure.

Dinner plates each contaminated by a like small amount of soil (a mixture of triglycerides, fatty acids and flour) are washed successively in 1 gallon of an aqueous solution of the detergent active compounds under test. A lather is first formed on the aqueous solution by allowing the solution to fall from a given height into the bowl used. Plates are washed successively until there is insufficient lather left to cover half the surface area of the solution in the bowl. The number of plates then washed is recorded.

ROSS-MILEN FOAM VOLUME TEST

This test is used to determine the amount of lather formed in allowing a solution to fall from a given height. Full details of the test are obtainable from "Oil and Soap", Volume 18 (1941), pp. 99–102.

The sulphobetaines used in the Examples were prepared by the following procedures, particularly illustrated by the production of hexadecyl pyridine sulphobetaines.

α-Hexadecene was sulphonated in a thin film reactor using a mixture of sulphur trioxide and air and the mixed sultones were extracted from the reaction mixture by petroleum ether (60°–80° C). 1216 g of the mixed sultones were placed in a flask fitted with a reflux condenser. 632 g. (100% excess) of pyridine was added to the mixed sultones, and the mixture refluxed for 6 hours. Acetone was then added to the warm mixture and on cooling the resultant sulphobetaines were precipitated and filtered off. Purification of the sulphobetaines was accomplished by dissolving the sulphobetaines in ethanol and then adding acetone to the solution. The yield of the mixed sulphobetaines was about 890 g.

Other alkyl pyridine sulphobetaines were prepared by similar processes to that described above, using the respective α-olefins in each case, but the amounts of pyridine used in the reactions were varied to allow for the different molecular weights of the sultones, so as to use a 100% excess of pyridine in each case.

Alkyl picoline sulphobetaines were prepared by similar processes to those described above with the exception that the amounts of the picolines used instead of the pyridine were adjusted to allow for the differing molecular weights of the sultones used and the different molecular weights of the picolines in comparison with that of pyridine, so that in each case a 100% excess of the picoline was present.

Alkyl trimethylammoniosulphobetaines were prepared by similar processes to those described above, again with due allowance for the molecular weights of the sultones and trimethylamine. However, as trimethylamine in gaseous at room temperature the reactions were carried out under a pressure of about 300 pounds per square inch.

The sulphobetaines produced were mixtures of the γ- and δ-sulphobetaines. In some cases the relative proportions of the γ- and δ-isomers were determined and in these cases the predominating isomer is reported in the Examples.

EXAMPLE 1

A detergent composition having the following formulation was prepared by admixture of the ingredients and water to form a slurry which was then drum-dried to give a powder having a water content of about 5%.

| Ingredient | Percentage (on anhydrous basis) |
|---|---|
| hexadecyl-pyridino-sulphobetaines (mainly γ) | 20 |
| sodium sulphate | 40 |
| sodium silicate (alkaline) | 10 |
| sodium chloride | 30 |

For the purposes of comparison a conventional basic composition also of about 5% water content was similarly prepared to the following formulation:

| Ingredient | Percentage (on anhydrous basis) |
|---|---|
| sodium dodecylbenzene | 20 |
| sodium tripolyphosphate | 35 |
| sodium silicate (alkaline) | 10 |
| sodium chloride | 35 |

Both products were tested to determine their detergencies at 0.4% concentration in 25° H water at 45° C with the following results:

| | Detergency % |
|---|---|
| Product of Example 1 | 75.2 |
| Comparative product | 68.0 |

A further composition was prepared by the procedure described for Example 1 but using hexadecyl trimethylammoniosulphobetaines instead of the pyridine sulphobetaines. In this case the detergency of the composition was 68.9%.

EXAMPLE 2

A heavy-duty liquid detergent composition having the following formulation was prepared by mixing the ingredients shown:

| Ingredient | | Percentage | |
|---|---|---|---|
| hexadecyl pyridino sulphobetaines (mainly γ) | | 20.0 | |
| sodium toluene sulphonate | | 3.6 | |
| methyl cellulose (thickening agent) | | 2.0 | (approx.) |
| sodium silicate (alkaline) | | 5.0 | |
| water | to | 100 | |

The detergency of the composition in 25° H water at 45° C was determined at concentrations of 0.2% and 0.4% and the results compared with those obtained for a conventionally-available built liquid detergent composition containing a nonionio detergent active compound. The results were as follows:

| | Detergency % | |
|---|---|---|
| | 0.2% | 0.4% |
| Composition containing the pyridine sulphobetaines | 70.3 | 76.9 |
| Conventional built nonionic composition | 60.4 | 75.4 |

The results of Examples 1 and 2 demonstrate the effective detergencies of the solid and liquid compositions incorporating sulphobetaines according to the present invention. It will be noted in particular that neither of the Examples incorporate detergency builders as do the comparative conventional detergent compositions. By way of further comparison, the detergency of the conventional nonionic composition formulated without its detergency builder was only 49.3%.

EXAMPLE 3

In order to compare the soil-removal efficiencies of solutions containing various sulphobetaines in accordance with this invention with a solution containing a conventional anionic synthetic detergent active compound and a conventional detergency builder, in both hard and soft water, a series of solutions (pH adjusted to 10 in each case by the addition of sodium hydroxide,) were prepared as detailed below and their detergencies determined at 45° C.

Details of the solutions prepared and their detergencies were as follows:

| | Percentage concentration of ingredient Solution | | | | | |
|---|---|---|---|---|---|---|
| Ingredient | A | B | C | D | E | F |
| hexadecyl pyridino sulphobetaines (mainly γ) | 0.04 | 0.03 | — | — | — | — |
| hexadecyl trimethylammonia | — | — | 0.08 | — | — | — |

-continued

| | | | | | | |
|---|---|---|---|---|---|---|
| sulphobetaines (mainly γ) | | | | | | |
| hexadecyl α-picolino sulphobetaines (mainly %) | — | — | — | 0.08 | — | — |
| hexadecyl pyridino sulphobetaines (mainly γ) | — | — | — | — | 0.08 | — |
| sodium dodecyl benzene sulphenate | — | — | — | — | — | 0.08 |
| sodium tripolyphosphate | — | — | — | — | — | 0.10 |
| | Detergency % | | | | | |
| 0° H water | 77.9 | 73.5 | 73.5 | 72.5 | 79.0 | 81.2 |
| 25° H water | 71.0 | 70.1 | 76.2 | 68.6 | 71.3 | 60.5 |

These results demonstrate the outstanding detergent properties of a variety of sulphobetaines in accordance with this invention, particularly in hard water the use of which depresses the detergency of the sulphobetaine solutions to a much lesser extent than of the built sodium dodecylbenzene sulphonate solution.

EXAMPLE 4

In order to compare the detergencies of solutions of sulphobetaines and sodium dodecyl benzene sulphonate in the presence and absence of a conventional detergency builder, sodium tripolyphosphate, a series of solutions in 25° H water (pH 10) at 45° C were prepared as detailed below and their detergencies determined with the following results:

| Ingredient | Concentration of ingredient % Solution | | | |
|---|---|---|---|---|
| | A | B | C | D |
| hexadecyl pyridino sulphobetaines (mainly γ) | 0.08 | 0.08 | — | — |
| sodium dodecyl benzene sulphonate | — | — | 0.08 | 0.08 |
| sodium tripolyphosphate | — | 0.1 | — | 0.1 |
| Detergency % | 71.3 | 85.0 | 15.3 | 60.5 |

The results show that the sulphobetaines used in accordance with the invention possess the better detergent properties in hard water, both in the presence and in the absence of the sodium tripolyphosphate.

EXAMPLE 5

In order to demonstrate the effect of varying the amount of conventional anionic detergent active compounds used in compositions comprising sulphobetaines in accordance with the invention, a number of solutions containing various amounts of sulphobetaines and in some cases an anionic detergent active compound were prepared using 25° H water at pH 10 and their percentage detergencies at 45° C determined with the results shown in Table I below:

These results show a decrease in detergency as the amount of anionic detergent active compound is increased. A corresponding increase in lathering is seen from Examples following.

EXAMPLE 6

In order to demonstrate the effective detergencies of the sulphobetaines of the invention on washing hydrophobic as well as hydrophilic fibres, a 0.1% solution of a sulphobetaine in 25° H water was prepared and its detergency for cotton and polyester fabrics was determined at 25° C and 45° C. For purposes of comparison the procedure was repeated using a solution of a conventional anionic detergent active compound and a detergency builder. The results were as follows:

| Solution ingredients | Detergency % | | | |
|---|---|---|---|---|
| | Cotton fabric | | Polyester fabric | |
| | 25° C | 45° C | 25° C | 45° C |
| hexadecyl pyridino sulphobetaines (mainly γ) | 66.1 | 87.0 | 73.2 | 94.5 |
| sodium dodecyl benzene sulphonate (0.1%) and sodium tripolyphosphate (0.1%) | 45.1 | 72.1 | 35.0 | 83.7 |

The sulphobetaine is seen to have an exceptional detergency on polyester fabrics, particularly in cool water in relation to the detergency of the built anionic compound solution.

EXAMPLE 7

In order to show the effect of temperature on the detergency of sulphobetaines used in accordance with the invention, in comparison with the effect on a conventional anionic detergent active compound, with and without a builder, solutions of the compounds in 25° H water (pH 10) were prepared and the detergencies determined at 25°, 45° and 70° C with the following results:

Table I

| Solution | Concentration of ingredients % | | | | | |
|---|---|---|---|---|---|---|
| | Hexadecyl pyridino sulphobetaines (mainly γ) | Hexadecyl pyridino sulphobetaines (mainly γ) | Sodium dodecyl benzene sulphonate | Soap[1] | Sodium tallow alcohol ethylene oxide (3 ED) ether sulphate | Detergency % |
| A | 0.08 | — | — | — | — | 71.3 |
| B | 0.08 | — | 0.02 | — | — | 54.0 |
| C | 0.08 | — | 0.04 | — | — | 48.0 |
| D | 0.08 | — | 0.06 | — | — | 40.6 |
| E | 0.08 | — | — | 0.02 | — | 54.2 |
| F | 0.08 | — | — | 0.04 | — | 58.0 |
| G | 0.08 | — | — | 0.05 | — | 52.1 |
| H | 0.04 | — | — | — | — | 71.0 |
| I | 0.04 | — | 0.04 | — | — | 21.3 |
| J | 0.04 | — | — | 0.04 | — | 55.3 |
| I | — | 0.08 | — | — | — | 81.4 |
| L | — | 0.08 | — | — | 0.02 | 79.2 |
| K | — | 0.08 | — | — | 0.04 | 72.9 |
| N | — | 0.08 | — | — | 0.06 | 71.4 |

[1]Sodium soap prepared from tallow class fats and nut oil fats in the ratio of SO:20

| Solution Ingredient | Detergency % 25° C | 45° C | 70° C |
|---|---|---|---|
| hexadecyl pyridino sulphobetaines (mainly γ) (0.1%) | —[1] | 85.6 | 91.8 |
| sodium dodecyl benzene sulphonate (0.1%) | 2.5 | 14.1 | 26.7 |
| sodium dodecyl benzene sulphonate (0.1%) and sodium tripolyphosphate (0.1%) | 34.7 | 67.8 | 79.0 |

[1]The Kraft point for this solution was above the test temperature so no result was obtainable. The same test repeated on a sample of mainly γ hexadecyl pyridino sulphobetaine gave a detergency of 66.1%.

EXAMPLE 8

To demonstrate the effective detergencies of the sulphobetaines used at varying pH, a series of solutions (0.1%) of hexadecyl pyridino sulphobetaines (mainly γ) were prepared using 24° H water and their detergencies at 45° C determined with the following results:

| pH[1] | Detergency (%) |
|---|---|
| 4 | 80.8 |
| 5 | 83.5 |
| 6 | 83.7 |
| 7 | 82.7 |
| 8 | 86.4 |
| 9 | 83.6 |
| 10 | 81.2 |

[1]The pH was adjusted using either hydrochloric acid or sodium hydroxide and in the latter cases 0.1% of sodium chloride was additionally added.

The sulphobetaines are soon to be remarkably effective in both acidic and alkaline solutions.

EXAMPLE 9

The detergencies of hexadecyl δ-picolino sulphobetaines (mainly δ), hexadecyl γ-picolino sulphobetaines (mainly δ), and mixtures thereof were determined in (24° H) water at 45° C and pH 10, with the following results:

| Sulphobetaines | Detergency % |
|---|---|
| hexadecyl β-picolino sulphobetaines (mainly γ) (0.1%) | 83.2 |
| hexadecyl γ-picolino sulphobetaines (mainly γ) (0.1%) | 74.7 |
| hexadecyl mixed β- and γ-picolino sulphobetaines (50:50) (0.1%) | 75.8 |

EXAMPLE 10

In order to demonstrate the lathering properties of compositions comprising both sulphobetaines and detergent active sulphates or sulphonates, a series of solutions were prepared and their lather stabilities determined in water of varying degrees of hardness. The results were as shown in Table II below.

TABLE II

| Sulphobetaine (A) | Sulphate or Sulphonate (B) | Molar Ratio of A to B | Conc. of solution (%) | Hardness of water | Relative Amount of Soil Required to Depress Lather: A alone | B alone | Mixture of A + B |
|---|---|---|---|---|---|---|---|
| Hexadecyl pyridino sulphobetaine(mainly γ) | sodium lauryl sulphate | 1:1 | 0.08 | 24° H | 7 | 10 | 28 |
| Hexadecyl pyridino sulphobetaines(mainly γ) | " | 1:1 | 0.08 | 24° H | 12 | 10 | 22 |
| Tetradecyl pyridino sulphobetaines(mainly γ) | " | 1:1 | 0.08 | 24° H | 5 | 10 | 31 |
| Hexadecyl pyridino sulphobetaines | sodium-α-$C_{16}$ olefin sulphonate | 1:1 | 0.08 | 24° H | 11 | 20 | 27 |
| " | " | 1:1 | 0.08 | 4° H | 13 | 20 | 26 |
| " | sodium dodecyl benzene sulphate | 1:1 | 0.08 | 4° H | 13 | 14 | 33 |
| " | " | 1:1 | 0.08 | 24° H | 11 | 14 | 30 |
| " | " | 1:1 | 0.04 | 4° H | 1 | 7 | 23 |
| " | " | 1:1 | 0.04 | 24° H | 1 | 1 | 22 |
| " | sodium alkyl (mixed $C_{12}$–$C_{15}$)sulphate | 1:1 | 0.08 | 4° H | 13 | 13 | 31 |
| " | " | 1:1 | 0.08 | 24° H | 11 | 17 | 19 |
| " | sodium lauryl ethylene oxide (BEC) ether sulphate | 1:1 | 0.04 | 24° H | 13.5 | 9 | 16 |

EXAMPLE 11

A dishwashing composition was prepared and its utility was examined by the plate washing test described above. The formulation of the composition was as follows:

| Ingredient | Percentage |
|---|---|
| Hexadecyl pyridino sulphobetaines | 23 |
| Sodium lauryl sulphate | 17 |
| Ethanol | 10 |
| Water | 50 |

By way of comparison the same test was completed on a leading commercial product having as active ingredients sodium dodecylbenzene sulphonate, an alkyl ether sulphate and an alkylolamide and an average commercial product having as active ingredients sodium dodecyl benzene sulphonate and a nonionic detergent active compound. In each of the tests the concentration of the detergent active ingredients was 0.04% and the water used of 24° hardness. The results were as follows:

| Composition | Number of Plates Washed |
|---|---|
| As Example according to the invention | 44 |
| Leading commercial dishwashing product | 37 |
| Average commercial dishwashing product | 30 |

A further composition was prepared in which the same sulphobetaines were used but the amount was decreased to 10 percent, the 17 percent of sodium lauryl sulphate was replaced by 9 percent of sodium dodecyl benzene sulphonate, the amount of ethanol was decreased to 5 percent and the water content was adjusted accordingly; this composition was also found to have excellent lathering properties.

EXAMPLE 12

In order to demonstrate the beneficial lathering properties of solutions of compositions according to the present invention, the lathering properties of several such solutions were determined by the Horn-Miles test and compared with the results obtained for solutions of the sulphobetaines and detergent active sulphates and sulphonates alone. The tests were conducted at 45° C in water of 0° hardness. The results are expressed in Table III below.

TABLE III

| Sulphobetaine (%) | Anionic Compound (B) | Molar Ratio of A to B | Conc. of Solution(%) | Ronn-miles Lather Test (es) | | |
|---|---|---|---|---|---|---|
| | | | | A alone | 3 times | Mixture of A + B |
| Dodecyl pyridino sulfobetaines | sodium lauryl sulfate | 1:1 | 0.1 | 12 | 18 | 21.5 |
| " | sodium decyl sulphonate | 1:1 | 0.1 | 12 | 0.5 | 16 |
| " | sodium dodecyl sulphonate | 1:1 | 0.1 | 12 | 15 | 17 |
| " | sodium hexyl benzene sulphonate | 1:1 | 0.1 | 12 | 2 | 16.5 |
| " | sodium octyl benzene sulphonate | 1:1 | 0.1 | 12 | 12 | 17.5 |
| " | sodium decyl benzene sulphonate | 1:1 | 0.1 | 12 | 19.5 | 22.5 |
| Tetradecyl pyridino sulphobetaines | sodium decyl sulphonate | 1:1 | 0.1 | 15 | 0.5 | 19.5 |
| " | sodium butyl benzene sulfonate | 1:1 | 0.1 | 15 | 0 | 16 |
| " | sodium hexyl benzene sulphonate | 1:1 | 0.1 | 15 | 2 | 17.5 |
| " | sodium octyl benzene sulphonate | 1:1 | 0.1 | 15 | 12 | 21 |
| " | sodium decyl benzene sulphonate | 1:1 | 0.1 | 15 | 19.5 | 22.5 |
| Tetradecyl pyridino sulphobetaines | Sodium laurate | 1:1 | 0.1 | 15 | 8 | 20 |
| " | Sodium di-(2-ethylhexyl) phosphate | 1:1 | 0.1 | 15 | 0 | 2 |
| Hexadecyl pyridino sulphobetaines | Sodium lauryl sulfate | 1:1 | 0.1 | 19 | 18 | 21.5 |

EXAMPLE 13

To show the effect of variation of the molar ratios of sulphobetaines and detergent active sulphates or sulphonates withih the preferred range a series of solutions were prepared and their lathering properties determined by the Ross-Miles test, using water of 0° hardness at 45° C. The results are in Table IV below.

TABLE IV

| Sulphobetaine (A) | Sulphate or Sulphonate (B) | Molar Ratio of A to B | Conc. of Solution % | Ronn-Miles Lather Test (es) | | |
|---|---|---|---|---|---|---|
| | | | | A alone | B alone | Mixture of A + B |
| Tetradecylpyridino sulphobetaines | Sodium lauryl sulphate | 1:1 | 0.1 | 15 | 19 | 22 |
| " | " | 2:3 | 0.1 | 15 | 18 | 23 |
| " | " | 3:2 | 0.1 | 15 | 18 | 23 |
| " | " | 1:1 | 0.05 | 10 | 6 | 14 |
| " | " | 2:3 | 0.05 | 10 | 6 | 20 |
| " | " | 3:2 | 0.05 | 10 | 6 | 21.5 |
| " | Sodium dodecyl sulphonate | 1:1 | 0.1 | 15 | 15 | 20.5 |
| " | " | 2:3 | 0.1 | 15 | 15 | 23 |
| " | " | 3:2 | 0.1 | 15 | 15 | 18.5 |
| " | " | 1:1 | 0.05 | 10 | 2 | 19 |
| " | " | 2:3 | 0.05 | 10 | 2 | 18 |
| " | " | 3.2 | 0.05 | 10 | 2 | 15 |

EXAMPLE 14

In order to demonstrate the effectiveness prepared from substituted pyridines and trialkylamines in mixtures with detergent active sulphates and sulphonates a series of solutions were prepared and their lathering properties by the Ross-Miles test, using water at 0° hardness at 45° C. The results are set out in Table V below:

TABLE V

| Sulphobetaine (A) | Sulphate or Sulphonate (B) | Molar Ratio of A to B | Conc. of Solution % | Ronn-Miles Lather Test (es) | | |
|---|---|---|---|---|---|---|
| | | | | A alone | B alone | Mixture of A + B |
| Tetradecyl α-picolino sulphobetaines (mainly γ) | sodium lauryl sulphate | 1:1 | 0.05 | 16 | 8 | 17.5 |
| Hexadecyl α-picolino sulphobetaines | " | 1:1 | 0.05 | 18 | 6 | 20 |
| Hexadecyl γ-picolino sulphobetaines | " | 1:1 | 0.05 | 19 | 6 | 21 |
| Hexadecyl trimethyl-ammonio sulphobetaines | " | 1:1 | 0.05 | 19.5 | 6 | 21.5 |

What is claimed is:

1. A foam-forming detergent composition comprising (a) at least one water soluble sulphobetaine having the structural formula:

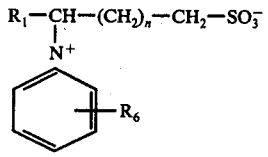

wherein $R_1$ is an alkyl group containing from 8 to 16 carbon atoms, $R_6$ is selected from the group consisting of a hydrogen atom and a methyl group and $n$ is an interger of at least 1 and not more than 2, and (b) at least one anionic detergent active surfactant selected from the group consisting of $C_8$–$C_{16}$ alkyl sulphonates, and $C_{10}$–$C_{16}$ alkyl sulphates, the molar ratio of the amount of the sulphobetaine to that of the anionic surfactant being from about 3:2 to 2:3 and wherein the total amount of sulphobetaine and anionic detergent active surfactant is in the range of from about 10 to about 50% by weight.

2. A composition according to claim 1, wherein the anionic detergent active is a $C_8$–$C_{16}$ alkyl sulphonate.

3. A composition according to claim 1, wherein the anionic detergent active is a $C_{10}$–$C_{16}$ alkyl sulphate.

4. The composition of claim 4 wherein $R_6$ is hydrogen.

5. The composition of claim 1 wherein $R_6$ is methyl.

6. The composition of claim 1 wherein the sulphobetaine is a hexadecyl pyridino sulphobetaine.

7. The composition of claim 1 wherein the sulphobetaine is a tetradecyl pyridino sulphobetaine.

8. The composition of claim 1 wherein the sulphobetaine is a dodecyl pyridino sulphobetaine.

9. The composition of claim 1 wherein the sulphobetaine is a hexadecyl $\alpha$-picolino sulphobetaine.

10. The composition of claim 1 wherein the sulphobetaine is a hexadecyl $\beta$-picolino sulphobetaine.

11. The composition of claim 1 wherein the sulphobetaine is a hexadecyl $\gamma$-picolino sulphobetaine.

12. The composition of claim 1 wherein the sulphobetaine is a tetradecyl $\alpha$-picolino sulphobetaine.

13. A composition according to claim 1 comprising an amount of the sulphobetaine in the range of from about 10 to about 35 percent by weight.

14. A composition according to claim 1 in the form of an aqueous liquid detergent composition.

15. A composition according to claim 1, wherein the molar ratio of the amount of the sulphobetaine to that of the anionic detergent active surfactant is about 1:1.

* * * * *